US010029767B2

(12) United States Patent
de Grasse

(10) Patent No.: US 10,029,767 B2
(45) Date of Patent: Jul. 24, 2018

(54) RECREATIONAL FLOTATION DEVICE

(71) Applicant: Aqua-Leisure Industries, Inc., Avon, MA (US)

(72) Inventor: Scott R. de Grasse, Marshfield, MA (US)

(73) Assignee: Aqua-Leisure Industries, Inc., Avon, MA (US)

( * ) Notice: Subject to any disclaimer, the term of this patent is extended or adjusted under 35 U.S.C. 154(b) by 0 days.

(21) Appl. No.: 15/835,546

(22) Filed: Dec. 8, 2017

(65) Prior Publication Data

US 2018/0162494 A1 Jun. 14, 2018

Related U.S. Application Data

(60) Provisional application No. 62/432,026, filed on Dec. 9, 2016.

(51) Int. Cl.
*B63B 35/76* (2006.01)

(52) U.S. Cl.
CPC ..... *B63B 35/76* (2013.01)

(58) Field of Classification Search
CPC ..... B63B 35/73
USPC ..... 441/129–131
See application file for complete search history.

(56) References Cited

U.S. PATENT DOCUMENTS 2,933,739 A * 4/1960 Ford ..... B63C 9/02 441/40
4,750,894 A * 6/1988 Nealey ..... B63C 9/04 114/345
D343,220 S 1/1994 Fireman
5,520,561 A * 5/1996 Langenohl ..... B63B 35/78 441/129
D375,990 S * 11/1996 Peterson ..... B63B 35/78 D21/804
5,628,275 A * 5/1997 Casey ..... A01K 1/0236 119/28.5
5,628,658 A * 5/1997 Clifford ..... A47C 15/006 441/130
D384,720 S 10/1997 Spomer
6,012,778 A * 1/2000 Peterson ..... A47C 4/54 297/452.41
D428,955 S 8/2000 Peterson
D438,838 S 3/2001 Mele
6,881,114 B2 * 4/2005 Zheng ..... B63B 7/08 441/129
D518,133 S 3/2006 Peterson
D520,092 S 5/2006 Peterson
D549,298 S 8/2007 Peterson
D551,733 S 9/2007 Peterson
D552,202 S 10/2007 Peterson
D562,424 S 2/2008 McKee
7,357,688 B2 * 4/2008 Ferrara ..... B63B 7/082 114/345
7,818,842 B2 * 10/2010 Marciano ..... A47C 17/64 441/131
D643,495 S 8/2011 Marciano
(Continued)

*Primary Examiner* — S. Joseph Morano
*Assistant Examiner* — Jovon Hayes
(74) *Attorney, Agent, or Firm* — Wolf, Greenfield & Sacks, P.C.

(57) ABSTRACT

Recreational flotation devices are generally described. The flotation device may comprise inflatable portions of different size that aid a user in achieving a sitting position.

15 Claims, 7 Drawing Sheets

(56) References Cited

U.S. PATENT DOCUMENTS

| | | | | |
|---|---|---|---|---|
| 8,622,746 | B2 * | 1/2014 | Gholami-Shabani .. | A63B 69/14<br>434/254 |
| 9,051,032 | B2 * | 6/2015 | Hanel ..... | B63B 35/74 |
| 9,623,938 | B2 * | 4/2017 | McNealey, IV ..... | B63B 35/76 |
| 2016/0022525 | A1 * | 1/2016 | Galitzer ..... | A61H 1/001<br>128/845 |
| 2016/0156304 | A1 * | 6/2016 | Smadja ..... | H02S 20/00<br>136/251 |

* cited by examiner

RECREATIONAL FLOTATION DEVICE

CROSS REFERENCE TO RELATED APPLICATION

This application claims priority to U.S. Provisional Application Ser. No. 62/432,026 entitled, "Recreational Flotation Device," filed on Dec. 9, 2016, which is incorporated herein by reference in its entirety.

FIELD OF INVENTION

This invention relates to recreational flotation devices, and particularly to inflatable recreational flotation devices.

BACKGROUND

Recreational flotation devices are among the most popular beach and pool recreational devices. Improvements to these devices are generally desired.

SUMMARY

A recreational flotation device is generally described according to one or more embodiments. In one or more embodiments, the recreational flotation device comprises an inflatable member having a polygonal shape and surrounding and defining an inner region. The inflatable member may comprise a plurality of inflatable portions. Each of the inflatable portions may correspond to a side of the polygonal shape. The plurality of inflatable portions may include first and second inflatable portions positioned substantially opposite to each other and configured such that, when fully inflated, the first inflatable portion has a greater volume than the second inflatable portion.

DETAILED DESCRIPTION OF THE INVENTION

Figure 1:
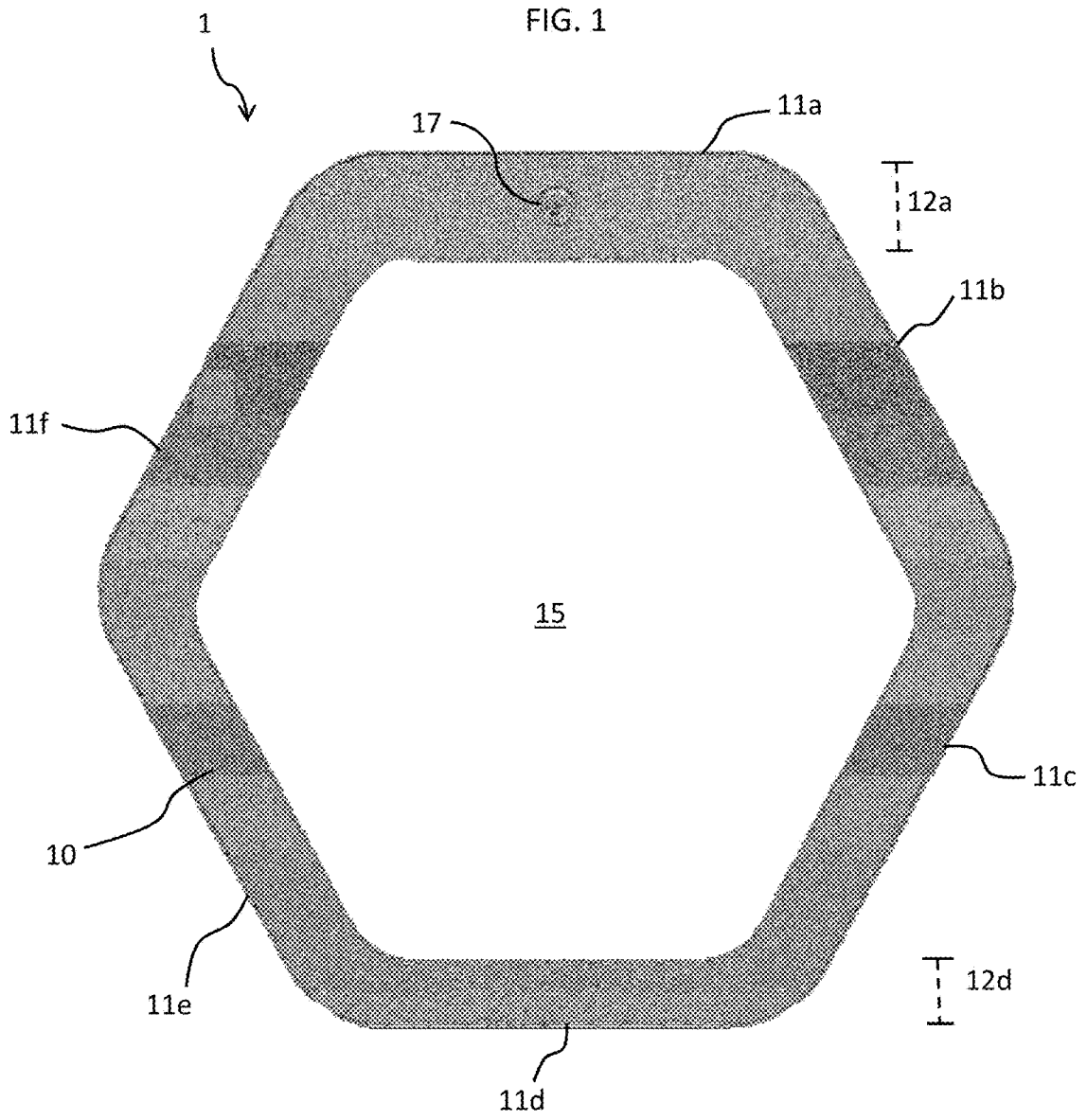
FIG. 1 is a drawing of a bottom view of a recreational flotation device, according to one or more embodiments.

FIG. 1 shows a bottom view of a recreational flotation device 1 in a fully inflated state, according to one or more embodiments. The device 1 comprises an inflatable member 10 having a polygonal shape (e.g., a hexagon). The inflatable member 10 surrounds and defines an inner region 15. The inflatable member 10 comprises a plurality of inflatable portions 11*a*-11*f*. Each of the inflatable portions 11*a*-11*f* corresponds to a side of the polygonal shape (in the illustrated embodiment, a hexagon). Among the inflatable portions 11*a*-11*f* are a first inflatable portion 11*a* and a second inflatable portion 11*d* that are positioned substantially opposite to each other. As used herein, the phrase "substantially opposite" refers to sides that are directly opposite to each other, in the case of a shape having an even number of sides. In the case of a polygon having an odd number of sides, the phrase "substantially opposite" refers to either of the two sides nearest to being opposite of the given side. In their fully inflated states, the first inflatable portion 11*a* has a greater volume than the second inflatable portion 11*d*, as indicated by the width 12*a* of the first inflatable portion 11*a* being greater than the width 12*d* of the second inflatable portion 12*d*.

Figure 2:
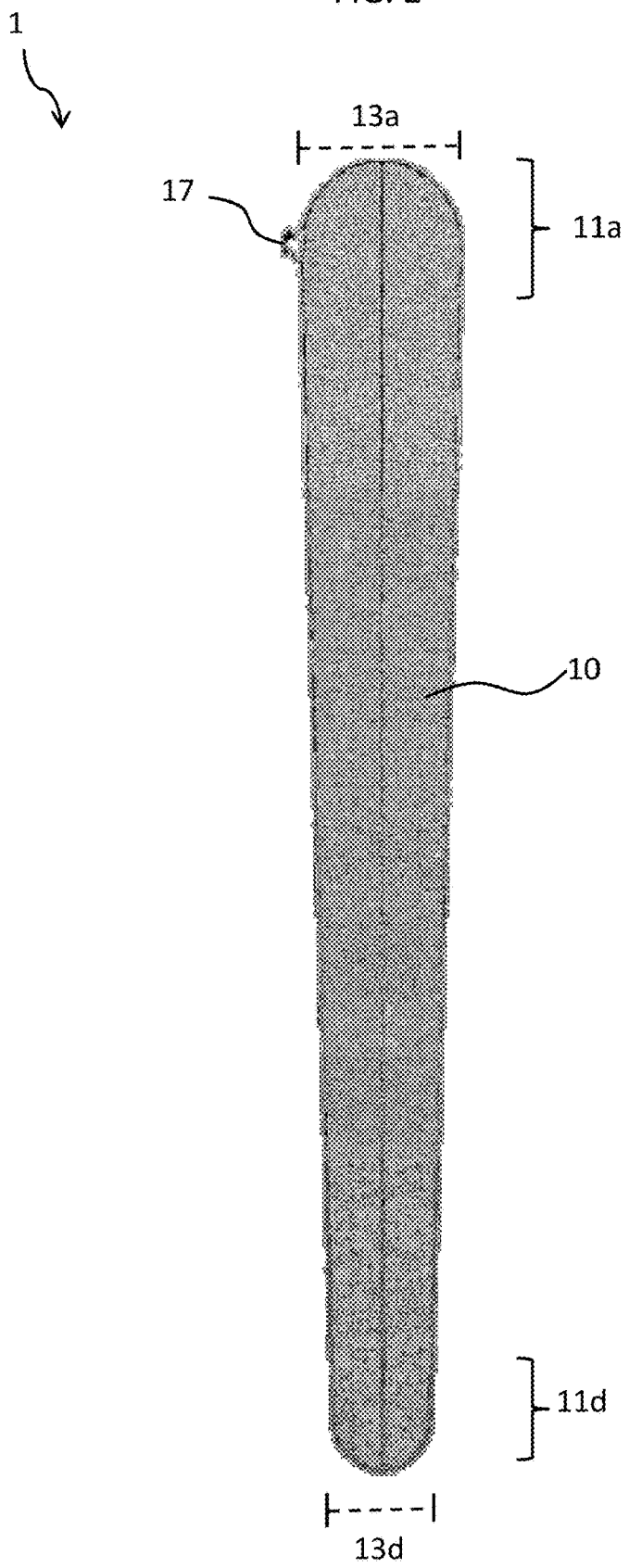
FIG. 2 is a drawing of a side view of a recreational flotation device, according to one or more embodiments.

The difference in size between the first inflatable portion 11*a* and the second, opposite inflatable portion 11*d* is further indicated in FIG. 2, which shows a side view of the recreational flotation device 1. As can be seen from this side view, the height 13*a* of the first inflatable portion 11*a* is greater than the height 13*d* of the second inflatable portion 11*d*. FIG. 2 also shows that the height of the inflatable member 10 tapers downwardly from the first inflatable portion 11*a* toward the opposite, second inflatable portion 11*d*, according to one or more embodiments.

The extent of tapering is reflected in the difference between the heights and volumes of the first and second portions. In some embodiments, the height of the second inflatable portion is between 20% and 90% of the height of the opposite, first inflatable portion, when fully inflated. In some embodiments the height of the second inflatable portion is between 50% and 75% of the height of the opposite, first inflatable portion, when fully inflated.

In some embodiments, each of the inflatable portions 11*a*-11*f* of the inflatable member 10 are in fluid communication with each other. In such embodiments, the inflatable member 10 has only one inflation valve 17, as shown in FIG. 3.

Figure 3:
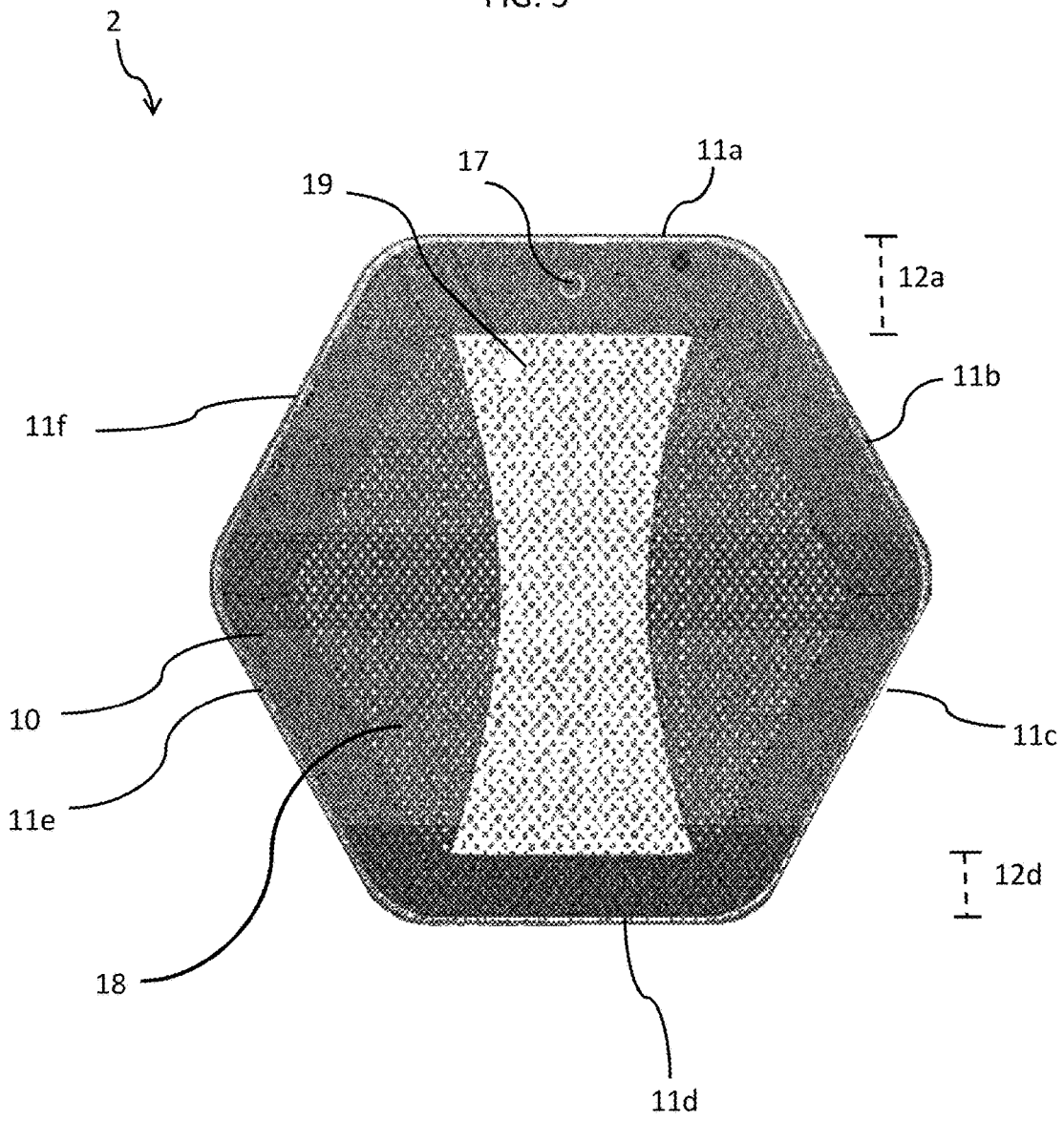
FIG. 3 is a drawing of a bottom view of a recreational flotation device, according to one or more embodiments.
Figure 4:
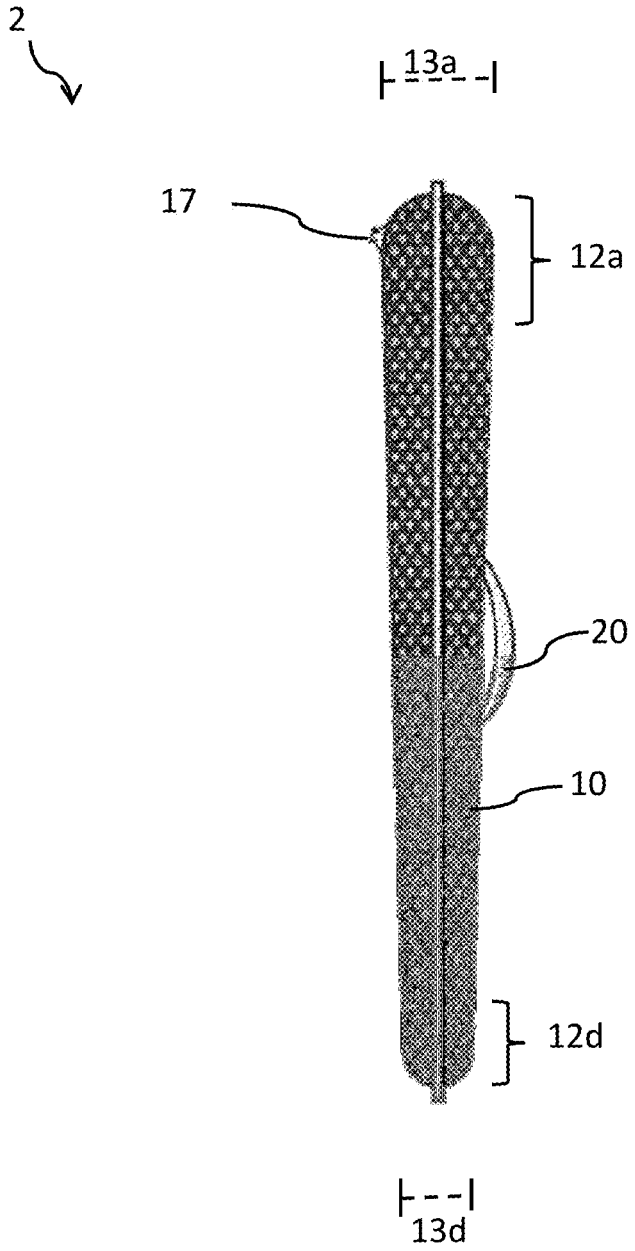
FIG. 4 is a drawing of a side view of a recreational flotation device, according to one or more embodiments.
Figure 5:
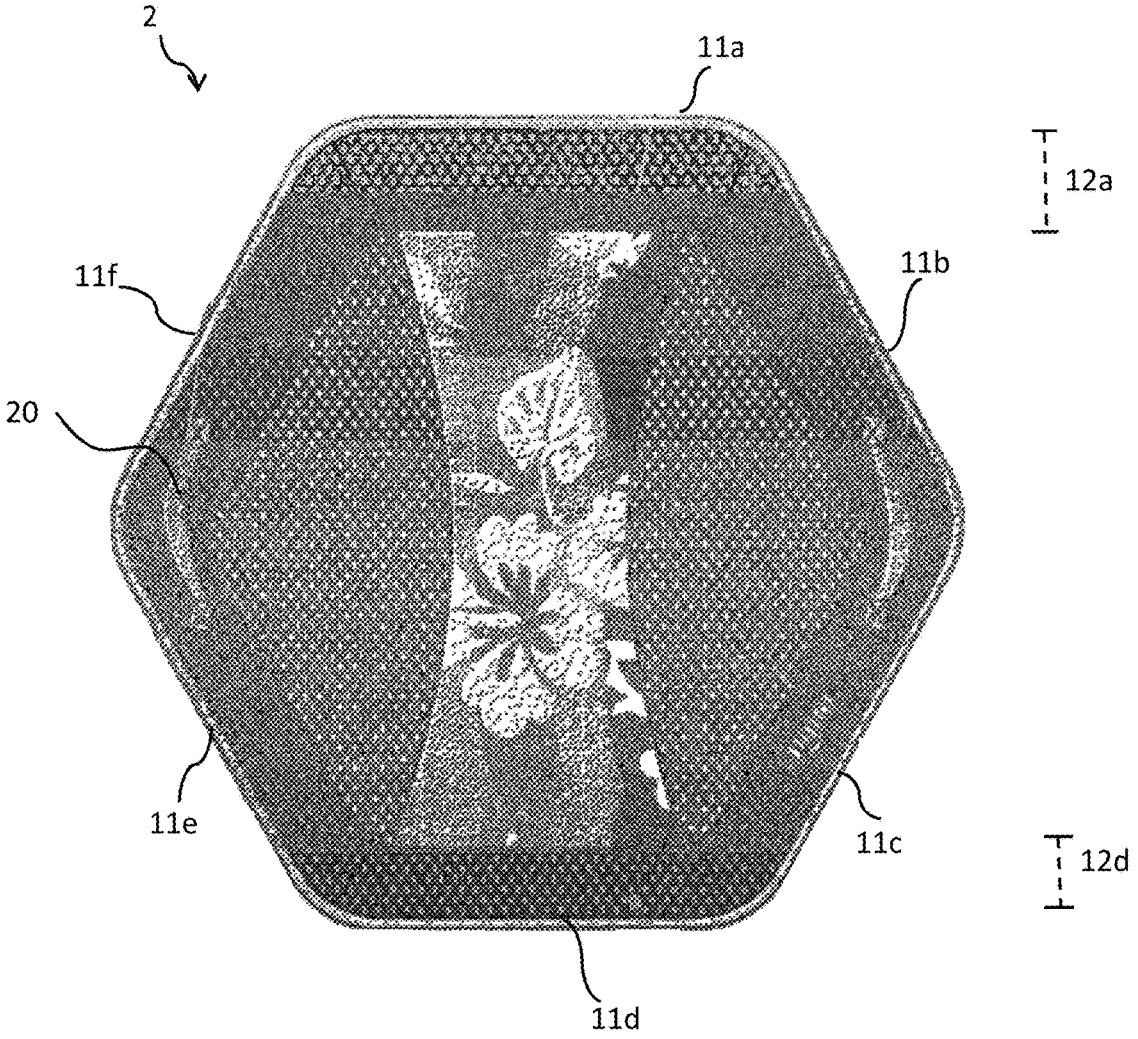
FIG. 5 is a drawing of a top view of a recreational flotation device, according to one or more embodiments.

In the embodiment shown in FIGS. 3-5, the device 2 further comprises a support member 18 positioned within the inner region 15 and attached to the inflatable member 10. The support member 18 may comprise a mesh layer. The device 2 further comprises a reinforcement layer 19 made from a suitable material. The support member 18 is attached to the inflatable member 10 along an entire perimeter of the inner region 15. The device 2 further comprises a pair of handles 20 positioned on the inflatable member 10 for a user to hold onto. The inflatable member 10 may be made from a suitable material such as PVC. As one example of potential dimensions for the floatation device 2, according to the embodiment shown in FIGS. 3-5, the width 12*a* and height 13*a* of a first inflatable portion 11*a* is 4.5 inches. The width 12*d* and height 13*d* of a second, opposite, inflatable portion 11*d* is 2.75 inches. The width where additional portions 11*b* and 11*c*, or 11*e* and 11*f*, abut is 4 inches. The entire length from a far end of the first inflatable portion 11*a* to a far end of the second inflatable portion 11*d* is 37 inches. The entire width as measured from where a far end of portions 11*e* and 11*f* meet and where a far end of portions 11*b* and 11*c* meet is 39 inches. These dimensions are by way of illustration and only may be adjusted, as would be understood by a person of ordinary skill in the art, and still fall within the scope of the disclosed invention.

Figure 6A:
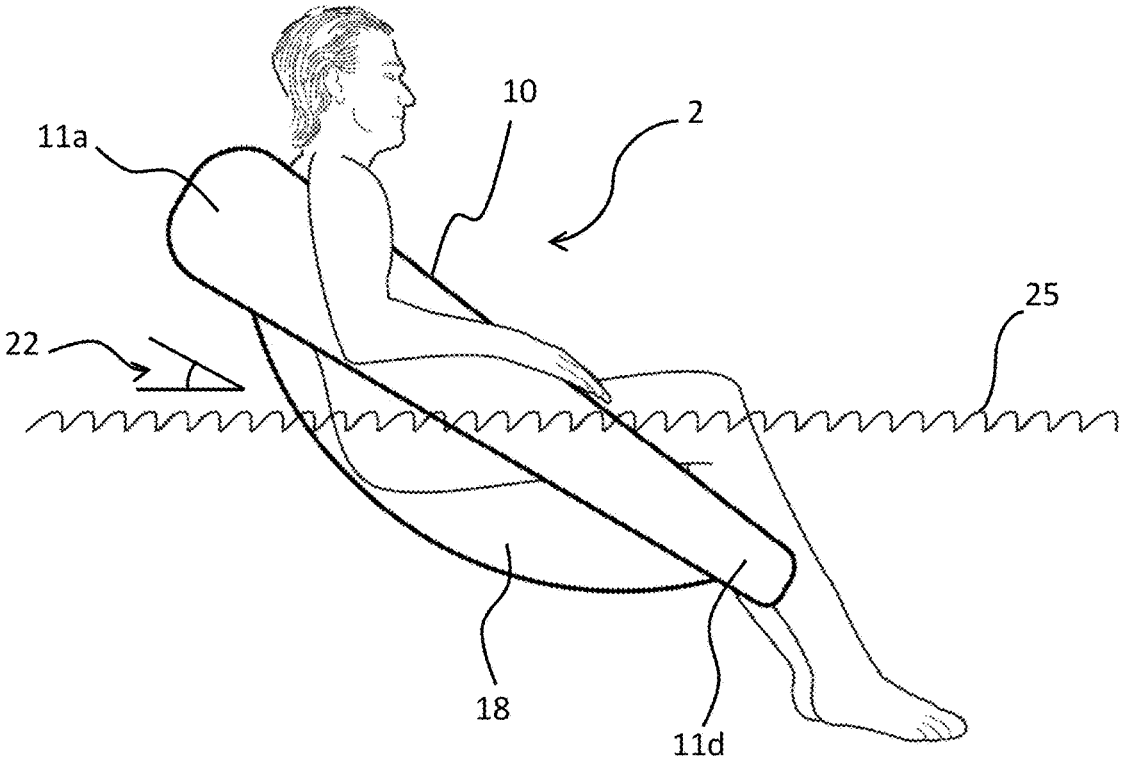
FIG. 6A is a drawing of a side view of a recreational flotation device, according to one or more embodiment, while being used in a sit-up mode.
Figure 6B:
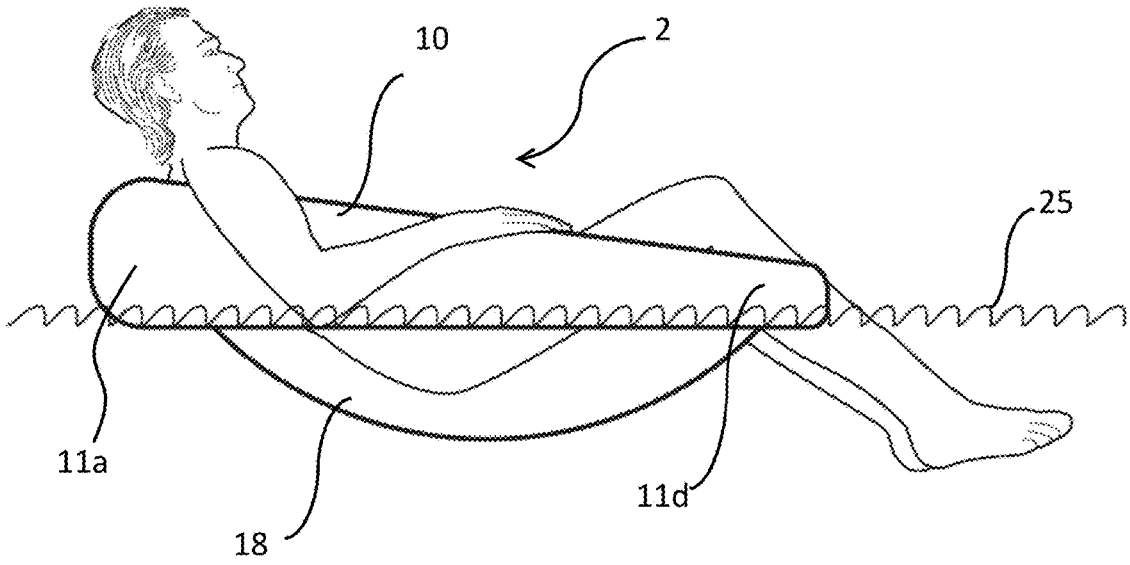
FIG. 6B is a drawing of a side view of a recreational flotation device, according to one or more embodiment, while being used in a lay-down mode.

Providing opposite inflatable portions of different sizes alters the relative buoyancy of the sides of the inflatable member 10. For example, as shown in FIG. 6A, because the second inflatable portion 11*d* has a smaller volume and thus is filled with less air than the first inflatable portion 11*a*, it is more disposed or biased toward submersion in water 25 than the first inflatable portion, when a user is positioned on the support member 18. As a result, a user, may easily place himself into a seated position when on the support member 18 of the device 2 with his head or back resting on or near the first inflatable portion 11*a* and his legs on or near the second portion 11*d*, as illustrated in FIG. 6A, also referred to as a "sit-up mode." As used herein, the term "seated position" refers to a position in which a user is supported by the flotation device, and the bottom side of the inflatable member 10 forms an angle (shown as angle 22 in FIG. 6A) with the water surface 25 of from 30 degrees to 90 degrees. A user may also operate the flotation device 2 in a "lay-down mode," as illustrated in FIG. 6B, in which the bottom side of the inflatable member 10 of the device 2 is in line with, or parallel to, the water line 25.

In some embodiments, the polygonal shape is a regular-polygonal shape. As used herein, the term "regular polygon" refers to a polygon that is substantially equiangular (all interior angles are within 10% of the largest interior angle) and substantially equilateral (all sides are within 10% in length of the longest side, as measured from an interior edge). While the embodiments shown have a hexagonal shape, other shapes are possible.

From the description of at least one embodiment of the present disclosure, various alternations, modifications and improvements will readily occur to those skilled in the art. Such alterations, modifications and improvements are intended to be within the scope and spirit of the disclosure. Accordingly, the foregoing description is by way of example only and is not intended to be limiting.

The invention claimed is:

1. A recreational flotation device, comprising:

an inflatable member having a polygonal shape and surrounding and defining an inner region, the inflatable member comprising a plurality of inflatable portions, each of the inflatable portions corresponding to a side of the polygonal shape;

wherein the plurality of inflatable portions comprise first and second inflatable portions positioned substantially opposite to each other and configured such that, when fully inflated, the first inflatable portion has a greater volume than the second inflatable portion, and wherein the inflatable member is configured such that when inflated, the height of the inflatable member tapers downwardly from the first inflatable portion toward the second inflatable portion substantially opposite to the first inflatable portion.

2. The recreational flotation device of claim 1, further comprising a support member positioned within the inner region and attached to the inflatable member.

3. The recreational flotation device of claim 2, wherein the support member is attached to the inflatable member along an entire perimeter of the inner region.

4. The recreational flotation device of claim 2, wherein the support member comprises a mesh layer.

5. The recreational flotation device of claim 2, wherein the second inflatable portion is biased towards submersion in water when a user is positioned on the support member.

6. The recreational flotation device of claim 2, wherein the inflatable member is configured to place a user into a seated position when a user is positioned on the support member in water.

7. The recreational flotation device of claim 1, wherein the polygonal shape is a hexagon.

8. The recreational flotation device of claim 1, wherein the inflatable portions are in fluid communication with each other.

9. The recreational flotation device of claim 1, further comprising a pair of handles positioned on the inflatable member.

10. The recreational flotation of claim 1, wherein the height of the second inflatable portion is between 20% and 90% of the height of the first inflatable portion, when fully inflated.

11. The recreational flotation device claim 1, wherein the height of the second inflatable portion is between 50% and 75% of the height of the first inflatable portion, when fully inflated.

12. The recreational flotation device of claim 1, wherein the inflatable member comprises PVC.

13. The recreational flotation device of claim 1, wherein the polygonal shape is a regular-polygonal shape.

14. A recreational flotation device, comprising:

an inflatable member having a polygonal shape and surrounding and defining an inner region, the inflatable member comprising a plurality of inflatable portions, each of the inflatable portions corresponding to a side of the polygonal shape;

wherein the plurality of inflatable portions comprise first and second inflatable portions positioned substantially opposite to each other and configured such that, when fully inflated, the first inflatable portion has a greater volume than the second inflatable portion, wherein the height of the second inflatable portion is between 20% and 90% of the height of the first inflatable portion, when fully inflated.

15. A recreational flotation device, comprising:

an inflatable member having a polygonal shape and surrounding and defining an inner region, the inflatable member comprising a plurality of inflatable portions, each of the inflatable portions corresponding to a side of the polygonal shape;

wherein the plurality of inflatable portions comprise first and second inflatable portions positioned substantially opposite to each other and configured such that, when fully inflated, the first inflatable portion has a greater volume than the second inflatable portion, wherein the height of the second inflatable portion is between 50% and 75% of the height of the first inflatable portion, when fully inflated.

* * * * *